US011260508B2

(12) United States Patent
Huang et al.

(10) Patent No.: US 11,260,508 B2
(45) Date of Patent: Mar. 1, 2022

(54) TORQUE SOCKET TOOL

(71) Applicant: Hung-Wen Huang, Taichung (TW)

(72) Inventors: Hung-Wen Huang, Taichung (TW); Ta-Hsin Feng, Changhua County (TW)

(73) Assignee: Hung-Wen Huang, Taichung (TW)

( * ) Notice: Subject to any disclaimer, the term of this patent is extended or adjusted under 35 U.S.C. 154(b) by 0 days.

(21) Appl. No.: 17/039,206

(22) Filed: Sep. 30, 2020

(65) Prior Publication Data

US 2021/0187712 A1 Jun. 24, 2021

(30) Foreign Application Priority Data

Dec. 24, 2019 (TW) ..... 108147468

(51) Int. Cl.

| | |
|---|---|
| ***B25B 13/06*** | (2006.01) |
| ***B25B 23/00*** | (2006.01) |
| ***B25B 23/142*** | (2006.01) |
| ***B25B 23/14*** | (2006.01) |

(52) U.S. Cl.

CPC ..... *B25B 23/1427* (2013.01); *B25B 23/141* (2013.01)

(58) Field of Classification Search

CPC ..... B25B 23/1427; B25B 23/141; B25B 23/0035; B25B 23/1422; B25B 13/06

USPC ..... 81/473, 474, 475, 476, 477, 478, 480

See application file for complete search history.

(56) References Cited

U.S. PATENT DOCUMENTS 4,901,610 A * 2/1990 Larson ..... B25B 15/02 81/473

2011/0132156 A1* 6/2011 Lai ..... B25B 15/001 81/475

FOREIGN PATENT DOCUMENTS

TW I314087 B 9/2009

* cited by examiner

*Primary Examiner* — Orlando E Aviles
*Assistant Examiner* — Jacob Adam Montgomery

(57) ABSTRACT

A torque socket tool is provided, including: a main body, a driving member, an engaging member, a torque adjustment assembly and a rotating member. The main body defines an axial direction and has a first restricting portion. The driving member is rotatably disposed on the main body about the axial direction. The engaging member is slidably disposed on the main body. The torque adjustment assembly includes a mandrel. The mandrel is disposed within the main body and rotatable about the axial direction. The rotating member is non-rotatably sleeved with the mandrel and has a second restricting portion.

10 Claims, 7 Drawing Sheets

TORQUE SOCKET TOOL

BACKGROUND OF THE INVENTION

Field of the Invention

The present invention relates to a torque socket tool.

Description of the Prior Art

A torque tool is suitable for various needs by setting the appropriate torque. A conventional torque tool has a driving head at an end of a main body thereof and a torque adjusting mechanism is arranged in the main body with a rotatable handle or rotation ring for alternating the torque. When the handle or the rotation ring is rotated, the torque adjusting mechanism moves axially so as to adjust the torque, such as the torque tool disclosed in Taiwan Patent Number I314087.

However, the conventional torque tool has a complicated structure. An inner thread is required on the handle or the main body, which results in high cost. A hexagonal wrench is required to adjust the torque of the torque tool, which is inconvenient to use and greatly decreases operation efficiency.

The present invention is, therefore, arisen to obviate or at least mitigate the above-mentioned disadvantages.

SUMMARY OF THE INVENTION

The main object of the present invention is to provide a torque socket tool which has a simple structure and is convenient for mass manufacturing, and a torque of the torque socket tool is quickly and easily adjustable.

To achieve the above and other objects, the present invention provides a torque socket tool, including: a main body, a driving member, an engaging member, a torque adjustment assembly and a rotating member. The main body defines an axial direction and has a first restricting portion. The driving member is rotatably disposed on the main body about the axial direction. The driving member has a first engaging portion. The engaging member is slidably disposed on the main body and has a second engaging portion and a first sliding groove extending along the axial direction. The main body has a first restricting member disposed within the first sliding groove. The torque adjustment assembly includes a mandrel, an abutting member and an elastic member. The mandrel is disposed within the main body and rotatable about the axial direction. The abutting member is non-rotatably and slidably disposed within the main body and screwed with the mandrel. The elastic member is elastically abutted against and between the abutting member and the engaging member so that the first engaging portion is releasably engaged with the second engaging portion. The rotating member is non-rotatably sleeved with the mandrel and has a second restricting portion. The rotating member is slidable between a first position and a second position relative to the main body along the axial direction. When the rotating member is in the first position, the first restricting portion is restricted with the second restricting portion, and the rotating member is non-rotatable relative to the main body; when the rotating member is in the second position, the first restricting portion is free of restriction with the second restricting portion, the rotating member is rotatable relative to the main body to drive the mandrel to rotate, the mandrel drives the abutting member to move along the axial direction and adjust a compression of the elastic member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
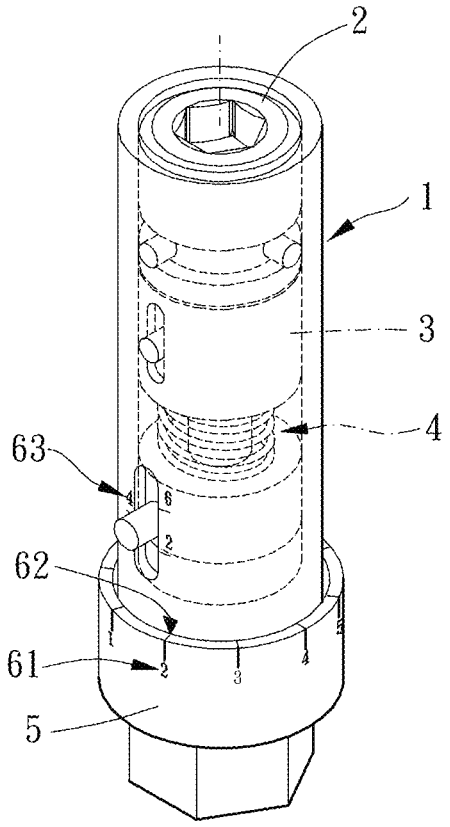
FIG. 1 is a stereogram of a preferable embodiment of the present invention.
Figure 2:
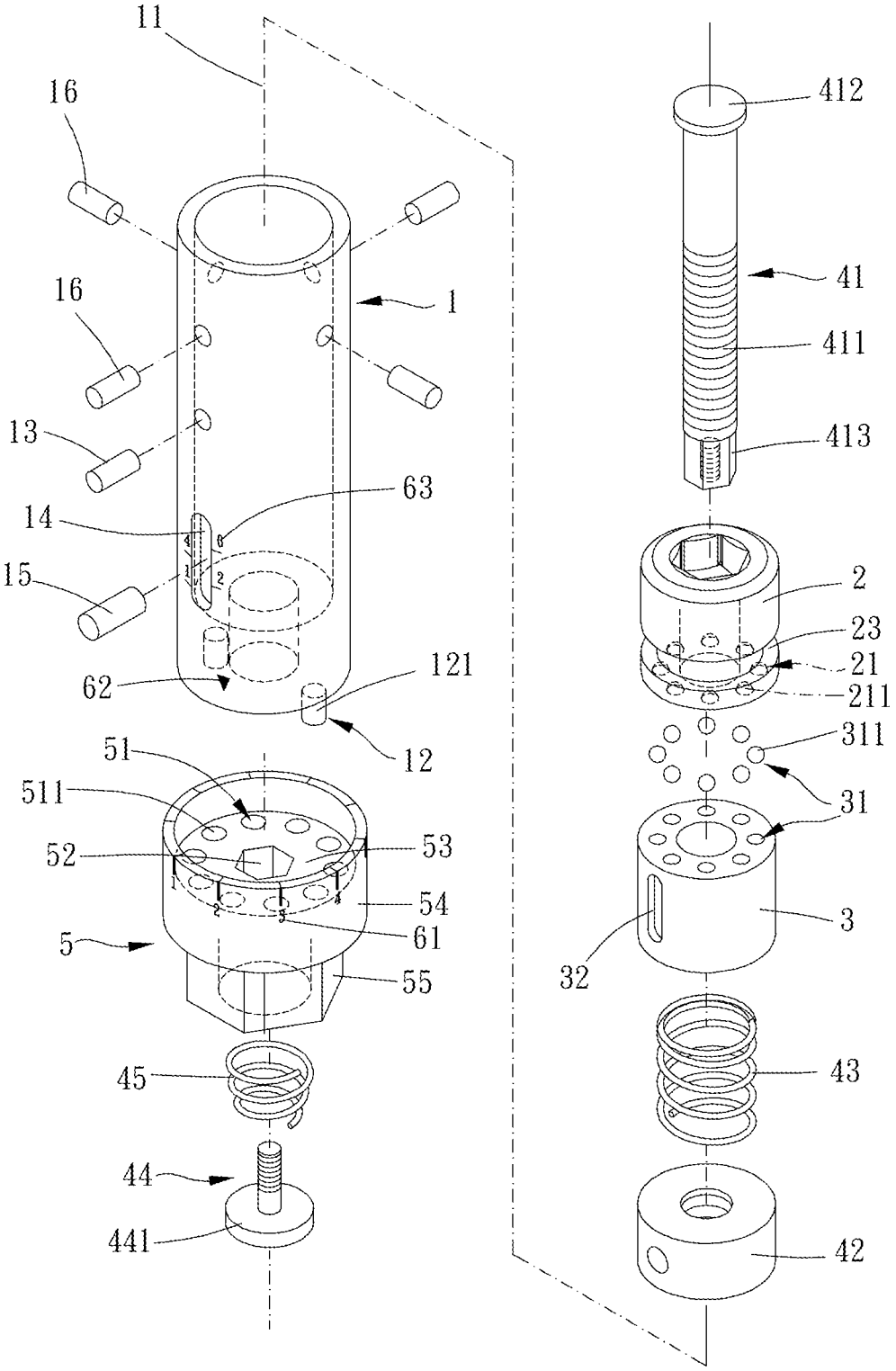
FIG. 2 is a breakdown drawing of a preferable embodiment of the present invention.
Figure 3:
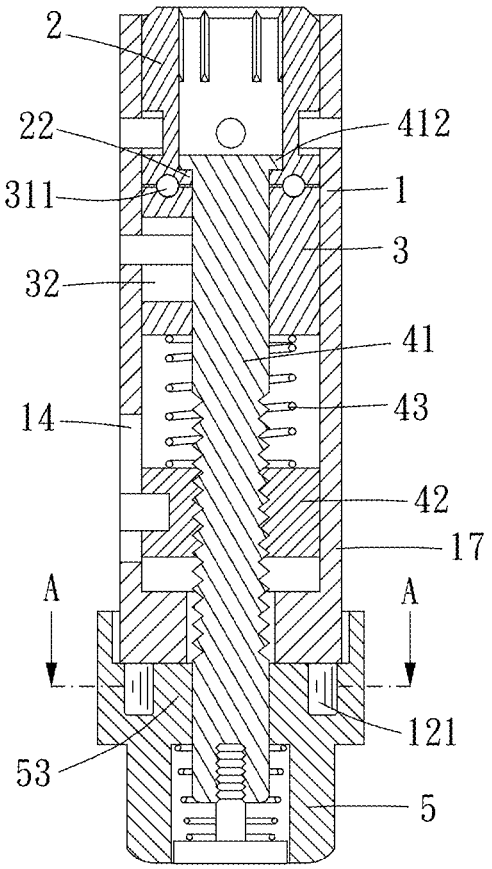
FIGS. 3 and 4 are schematic diagrams showing torque adjustment according to a preferable embodiment of the present invention.
Figure 4:
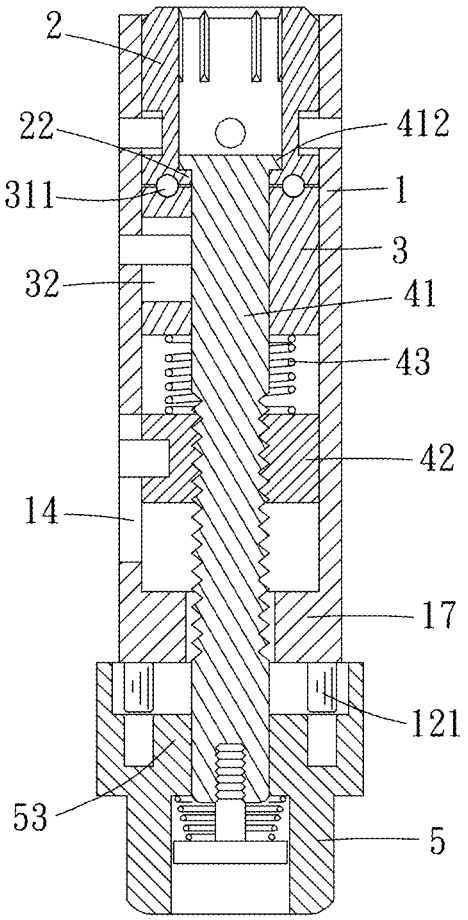
Figure 5:
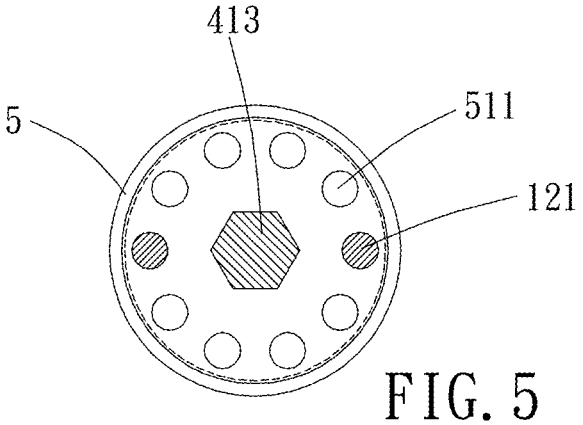
FIG. 5 is a cross-sectional view taken along line A-A of FIG. 3.

Please refer to FIGS. 1 to 7 for a preferable embodiment of the present invention. A torque socket tool of the present invention includes a main body 1, a driving member 2, an engaging member 3, a torque adjustment assembly 4 and a rotating member 5.

The main body 1 defines an axial direction 11 and has a first restricting portion 12.

The driving member 2 is rotatably disposed on the main body 1 about the axial direction 11, and the driving member 2 has a first engaging portion 21. In this embodiment, an outer circumferential wall of the driving member 2 has an annular groove 23, and the main body 1 has at least one third restricting member 16 disposed within the annular groove 23. Preferably, the main body 1 has a plurality of said third restricting members 16 which allow the driving member 2 to be rotatable relative to the main body 1 and unmovable along the axial direction 11.

The engaging member 3 is slidably disposed on the main body 1 and has a second engaging portion 31 and a first sliding groove 32 extending along the axial direction 11. The main body 1 has a first restricting member 13 disposed within the first sliding groove 32. In this embodiment, the first restricting member 13 is a pin inserted within the main body 1.

The torque adjustment assembly 4 includes a mandrel 41, an abutting member 42 and an elastic member 43. The mandrel 41 is disposed within the main body 1 and rotatable about the axial direction 11. The abutting member 42 is non-rotatably and slidably disposed within the main body 1 and screwed with the mandrel 41. The elastic member 43 is elastically abutted against and between the abutting member 42 and the engaging member 3 so that the first engaging portion 21 is releasably engaged with the second engaging portion 31. The elastic member 43 provides a predetermined torque. When a torque larger than the predetermined torque is exerted on the driving member 2, the first engaging portion 21 is disengaged from the second engaging portion 31 so that the driving member 2 is rotatable relative to the main body 1.

The rotating member 5 is non-rotatably sleeved with the mandrel 41 and has a second restricting portion 51. The rotating member 5 is slidable between a first position and a second position relative to the main body 1 along the axial direction 11.

When the rotating member 5 is in the first position, the first restricting portion 12 is restricted with the second restricting portion 51, and the rotating member 5 is non-rotatable relative to the main body 1 so that the mandrel 41 is non-drivable and the predetermined torque cannot be adjusted; when the rotating member 5 is in the second position, the first restricting portion 12 is free of restriction with the second restricting portion 51, the rotating member 5 is rotatable relative to the main body 1 to drive the mandrel 41 to rotate, and the mandrel 41 drives the abutting member 42 to move along the axial direction 11 and adjust a compression of the elastic member 43 so as to alter the predetermined torque.

Specifically, the main body 1 further has a second sliding groove 14 extending along the axial direction 11, and the abutting member 42 has a second restricting member 15 disposed within the second sliding groove 14. A peripheral edge of the second sliding groove 14 has a second scale 63 so that the predetermined torque is readable according to a position of the second restricting member 15 within the second sliding groove 14.

Moreover, one of the first engaging portion 21 and the second engaging portion 31 has a plurality of recesses 211 arranged annularly, and the other of the first engaging portion 21 and the second engaging portion 31 has at least one engaging ball 311 which is releasably engaged with one of the plurality of recesses 211. In this embodiment, the first engaging portion 21 has the plurality of recesses 211, the second engaging portion 31 has a plurality of said engaging balls 311, and the plurality of said engaging balls 311 are spherical so as to be smoothly disengageable from the plurality of recesses 211.

The mandrel 41 has a threaded portion 411 and slidably penetrates through the driving member 2, the engaging member 3, the elastic member 43 and the rotating member 5, and the threaded portion 411 is screwed with the abutting member 42.

Preferably, an end of the mandrel 41 has a flange 412 radially protruding therefrom, and an inner circumferential wall of the driving member 2 has a first blocking portion 22. A side of the flange 412 facing the engaging member 3 is blocked with the first blocking portion 22, which prevents the mandrel 41 from being slid in a direction toward the rotating member 5 and detached out of the main body 1. Another end of the mandrel 41 opposite to the flange 412 has a non-circular segment 413, and the rotating member 5 has a sleeving hole 52 with a cross-section corresponding to a cross-section of the non-circular segment 413 (hexagon in this embodiment). The sleeving hole 52 is slidably sleeved on the non-circular segment 413 so that the rotating member 5 is co-rotatable with the mandrel 41.

Specifically, the rotating member 5 further has a bottom wall 53, and the second restricting portion 51 is disposed on the bottom wall 53. One of the first restricting portion 12 and the second restricting portion 51 includes at least one convex portion 121, and the other of the first restricting portion 12 and the second restricting portion 51 includes a plurality of concave portions 511. When the rotating member 5 is in the first position, each of the at least one convex portion 121 is circumferentially restricted within one of the plurality of concave portions 511, and the rotating member 5 is non-rotatable relative to the main body 1. When the rotating member 5 is in the second position, the at least one convex portion 121 is free of circumferential interference with the plurality of concave portions 511, and the rotating member 5 is rotatable relative to the main body 1. The engaging member 3 is easy to be processed, relative to the main body 1, to form the first sliding groove 32, which reduces manufacturing cost. The engaging member 3 is disposed within the main body 1, which effectively avoids foreign objects entering the plurality of concave portions 511 or the at least one convex portion 121 so that the first engaging portion 21 is smoothly disengageable from the second engaging portion 31.

Furthermore, the mandrel 41 non-rotatably penetrates within the bottom wall 53, the plurality of concave portions 511 are annularly arranged on one of the bottom wall 53 and the main body 1 and extend along the axial direction 11, and the at least one convex portion 121 is rod-shaped and extends axially from the other of the bottom wall 53 and the main body 1. Each of the at least one convex portion 121 is inserted within one of the plurality of concave portions 511 when the rotating member 5 is in the first position, and each of the at least one convex portion 121 is detached from the plurality of concave portions 511 when the rotating member 5 is in the second position.

The rotating member 5 includes a large diametrical segment 54 and a small diametrical segment 55, and the bottom wall 53 is connected between the large diametrical segment 54 and the small diametrical segment 55. The main body 1 includes a barrel 17 on which the first restricting portion 12 is disposed. When the rotating member 5 is in the first position, the large diametrical segment 54 is radially overlapped with the barrel 17; when the rotating member 5 is in the second position, the large diametrical segment 54 is non-overlapped with the barrel 17 in a radial direction of the barrel 17. One of an outer circumferential wall of the large diametrical segment 54 and an outer circumferential wall of the main body 1 has a first scale 61 circumferentially disposed thereon, and the other of the outer circumferential wall of the large diametrical segment 54 and the outer circumferential wall of the main body 1 has an indication portion 62 corresponding to first scale 61. A number and positions of scale marks of the first scale 61 correspond to a number and positions of the plurality of concave portions 511. In this embodiment, the main body 1 has the indication portion 62 disposed thereon and the large diametrical segment 54 has the first scale 61 disposed thereon; the first restricting portion 12 has two said convex portions 121, and the second restricting portion 51 has the plurality of concave portions 511. The number of the plurality of concave portions 511 is ten. The predetermined torque is adjustable in a decimal manner. With the first scale 61 and the indication portion 62, the two said convex portions 121 are easy to be positioned with two of the plurality of concave portions 511 when the rotating member 5 is rotated so that the rotating member 5 is quickly moved to the first position.

Figure 6:
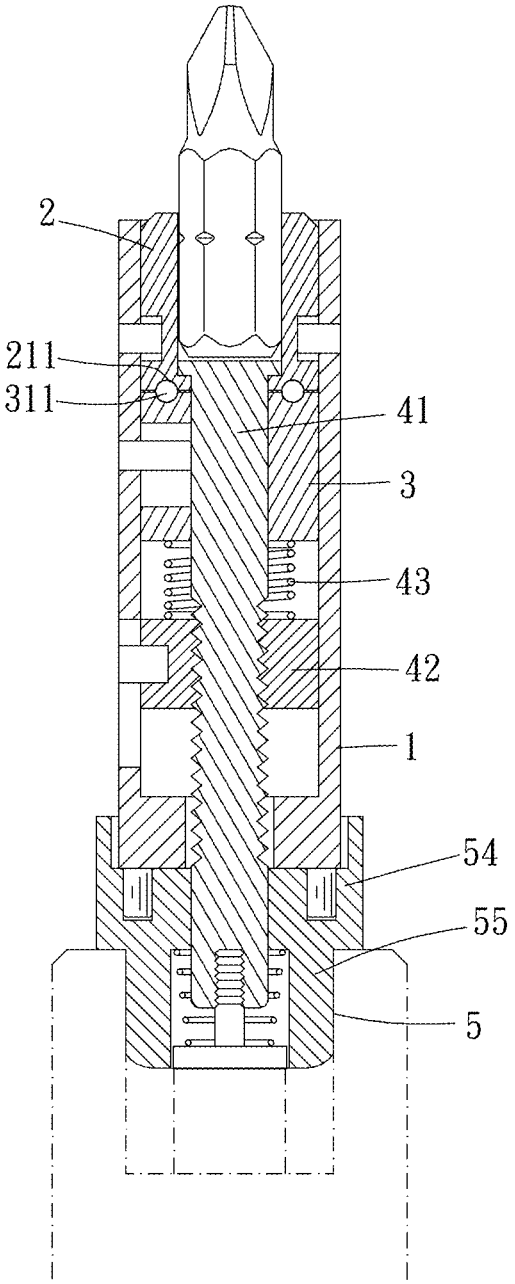
FIGS. 6 and 7 are schematic diagrams showing operation according to a preferable embodiment of the present invention.
Figure 7:
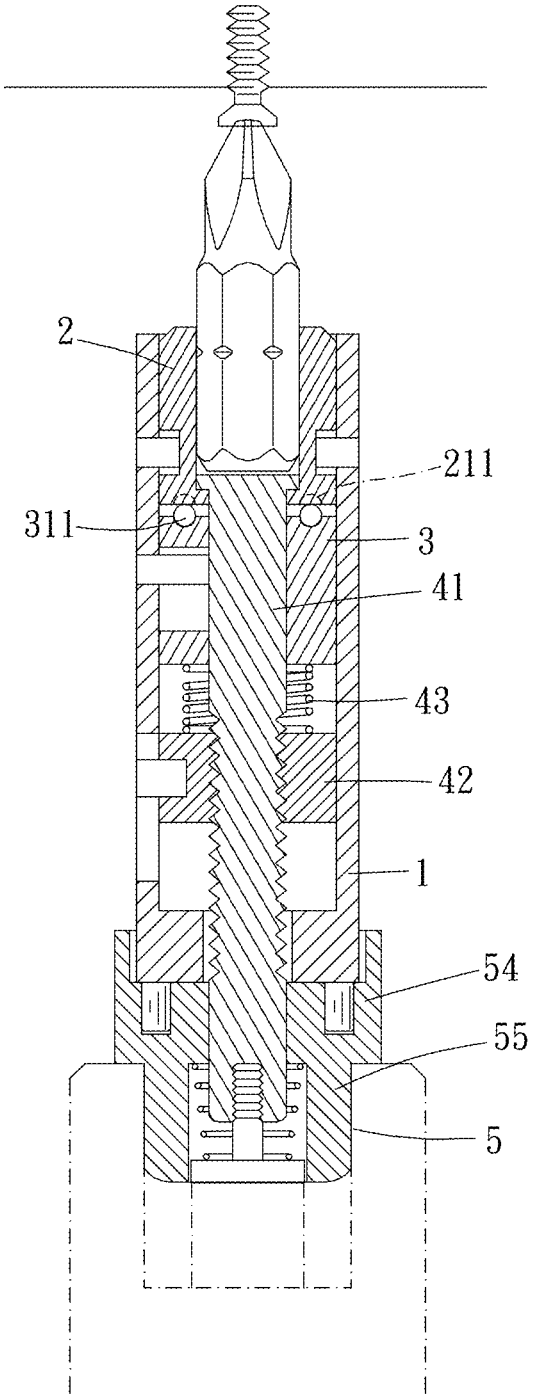
Figure 8:
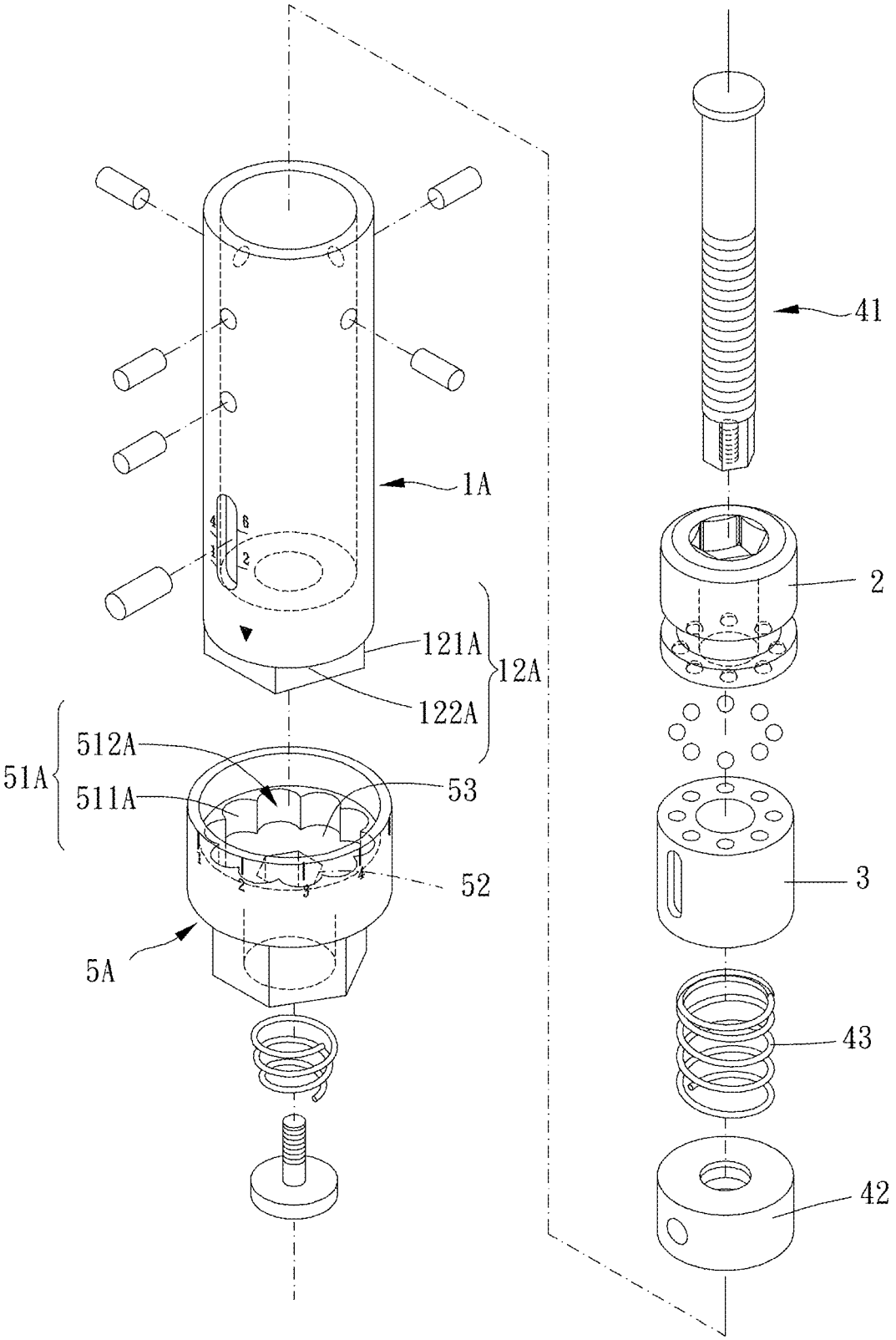
FIG. 8 is a breakdown drawing of another preferable embodiment of the present invention.
Figure 9:
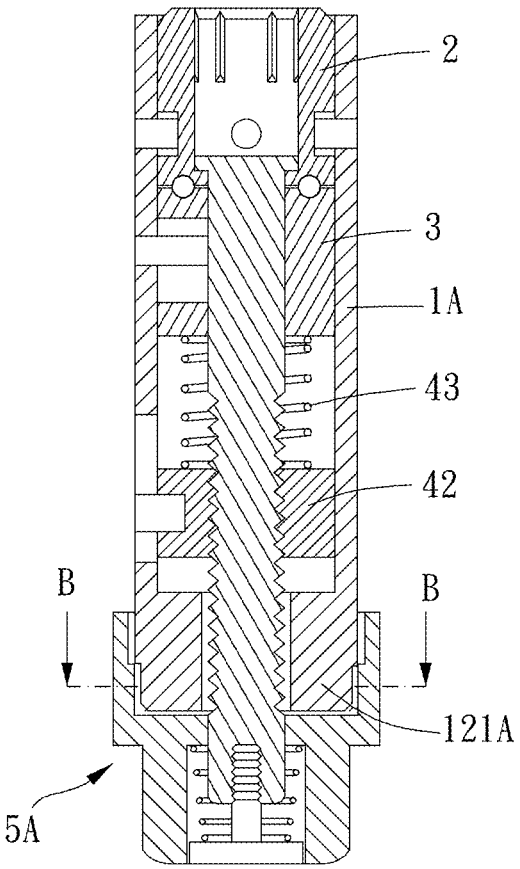
FIGS. 9 and 10 are schematic diagrams showing torque adjustment according to another preferable embodiment of the present invention.
Figure 10:
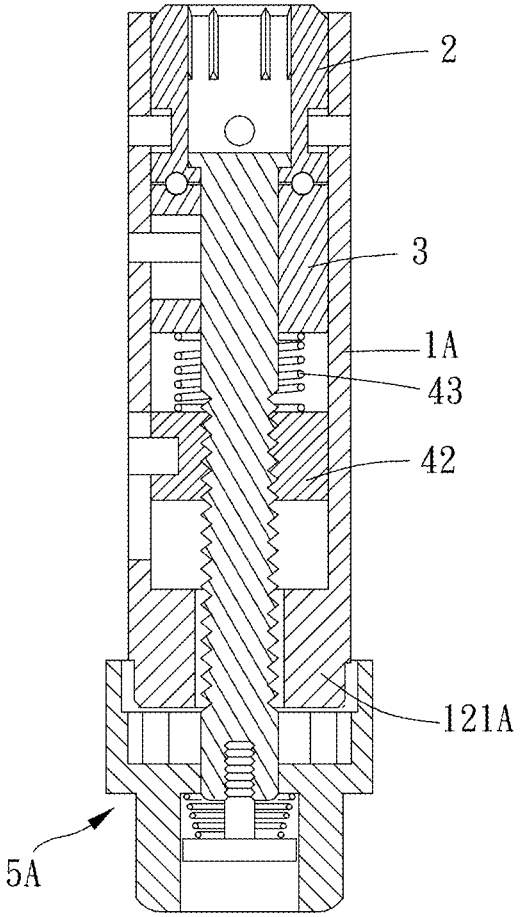
Figure 11:
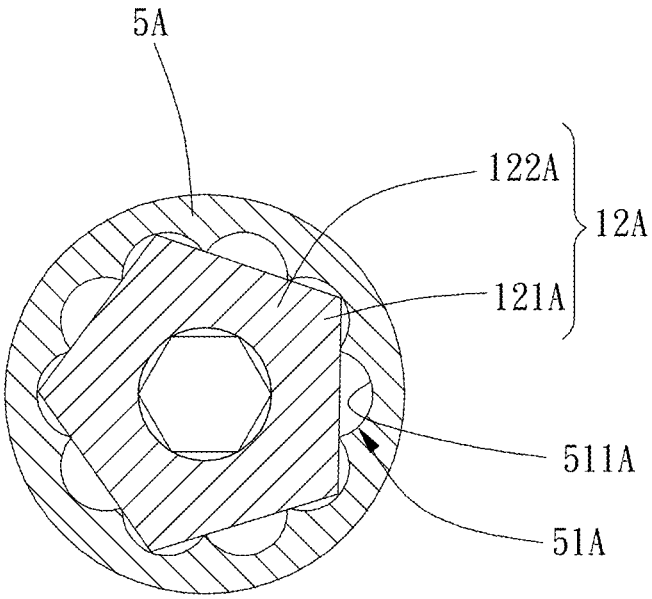
FIG. 11 is a cross-sectional view taken along line B-B of FIG. 9.

An end of the mandrel 41 remote the driving member 2 has a fastener 44, and a diametrical dimension of a head portion 441 of the fastener 44 is larger than a diametrical dimension of the sleeving hole 52. A spring 45 is sleeved on the mandrel 41 and elastically abutted against and between the head portion 441 and the bottom wall 53 so that the rotating member 5 has a tendency to move toward the first position. The spring 45 is tapered in a direction from the bottom wall 53 toward the head portion 441, which allows the spring 45 to have a shorter length after compression; the small diametrical segment 55 is non-circular rod-shaped and configured to be assembled with a tool such as a torque wrench so as to achieve labor-saving effect during operation (as shown in FIGS. 6 and 7).

Please refer to FIGS. 8 to 11 showing another preferable embodiment of the invention. One of the first restricting portion 12A and the second restricting portion 51A further includes a receiving groove 512A, and the other of the first restricting portion 12A and the second restricting portion 51A further includes a polygonal column 122A. In this embodiment, the first restricting portion 12A includes the polygonal column 122A, and the second restricting portion 51A includes the receiving groove 512A; the receiving groove 512A has the plurality of concave portions 511A radially communicated therewith, and the polygonal column 122A has the at least one convex portion 121A; the receiving groove 512A is disposed on the bottom wall 53, and the polygonal column 122A is disposed on the main body IA. When the rotating member 5A is in the first position, the polygonal column 122A is located within the receiving groove 512A and each of the at least one convex portion 121A is engaged with one of the plurality of concave portions 511A; when the rotating member 5A is in the second position, the polygonal column 122A is detached from the receiving groove 512A, which also provides quick adjustment of the predetermined torque.

In summary, the engaging member is easy to be processed, relative to the main body, to form the first sliding groove, which reduces manufacturing cost. The engaging member is disposed within the main body, which effectively avoids foreign objects entering the plurality of concave portions and the two said convex portions, so that the first engaging portion is smoothly disengageable from the second engaging portion. In addition, with the first scale and the indication portion, the two said convex portions are easy to be positioned with two of the plurality of concave portions when the rotating member is rotated so that the rotating member is quickly moved to the first position.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque socket tool, including:

a main body, defining an axial direction, having a first restricting portion;

a driving member, rotatably disposed on the main body about the axial direction, the driving member having a first engaging portion;

an engaging member, slidably disposed on the main body, having a second engaging portion and a first sliding groove extending along the axial direction, the main body having a first restricting member disposed within the first sliding groove;

a torque adjustment assembly, including a mandrel, an abutting member and an elastic member, the mandrel being disposed within the main body and rotatable about the axial direction, the abutting member being non-rotatably and slidably disposed within the main body and screwed with the mandrel, the elastic member being elastically abutted against and between the abutting member and the engaging member so that the first engaging portion is releasably engaged with the second engaging portion;

a rotating member, non-rotatably sleeved with the mandrel and having a second restricting portion, the rotating member being slidable between a first position and a second position relative to the main body along the axial direction;

wherein when the rotating member is in the first position, the first restricting portion is restricted with the second restricting portion, and the rotating member is non-rotatable relative to the main body; when the rotating member is in the second position, the first restricting portion is free of restriction with the second restricting portion, the rotating member is rotatable relative to the main body to drive the mandrel to rotate, and the mandrel drives the abutting member to move along the axial direction and adjust compression of the elastic member.

2. The torque socket tool of claim 1, wherein the main body further has a second sliding groove extending along the axial direction, and the abutting member has a second restricting member disposed within the second sliding groove.

3. The torque socket tool of claim 1, wherein each of the first engaging portion and the second engaging portion has a plurality of recesses arranged annularly, and one of the first engaging portion and the second engaging portion further includes at least one engaging ball which is releasably engaged with one of the plurality of recesses of each of the first engaging portion and the second engaging portion.

4. The torque socket tool of claim 1, wherein the mandrel has a threaded portion and slidably penetrates through the driving member, the engaging member, the elastic member and the rotating member, and the threaded portion is screwed with the abutting member.

5. The torque socket tool of claim 4, wherein an end of the mandrel has a flange radially protruding therefrom, an inner circumferential wall of the driving member has a first blocking portion protruding therefrom, a side of the flange facing the engaging member is blocked with the first blocking portion, another end of the mandrel opposite to the flange has a non-circular segment, the rotating member has a sleeving hole with a cross-section corresponding to a cross-section of the non-circular segment, and the sleeving hole is slidably sleeved on the non-circular segment.

6. The torque socket tool of claim 1, wherein the rotating member further has a bottom wall, the second restricting portion is disposed on the bottom wall, one of the first restricting portion and the second restricting portion includes at least one convex portion, the other of the first restricting portion and the second restricting portion includes a plurality of concave portions; when the rotating member is in the first position, each of the at least one convex portion is circumferentially restricted within one of the plurality of concave portions; when the rotating member is in the second position, the at least one convex portion is free of circumferential interference with the plurality of concave portions.

7. The torque socket tool of claim 6, wherein the rotating member includes a large diametrical segment and a small diametrical segment having a smaller diameter than the large diametrical segment, the bottom wall is connected between the large diametrical segment and the small diametrical segment, the main body includes a barrel on which the first restricting portion is disposed; when the rotating member is in the first position, the large diametrical segment is radially overlapped with the barrel; when the rotating member is in the second position, the large diametrical segment is non-overlapped with the barrel in a radial direction of the barrel;

one of an outer circumferential wall of the large diametrical segment and an outer circumferential wall of the main body has a first scale circumferentially disposed thereon, and the other of the outer circumferential wall of the large diametrical segment and the outer circumferential wall of the main body has an indication portion corresponding to the first scale, and a number and positions of scale marks of the first scale correspond to a number and positions of the plurality of concave portions.

8. The torque socket tool of claim 6, wherein the mandrel non-rotatably penetrates within the bottom wall, the plurality of concave portions are annularly arranged on one of the bottom wall and the main body and extend along the axial direction, the at least one convex portion is rod-shaped and extends axially from the other of the bottom wall and the main body; each of the at least one convex portion is inserted within one of the plurality of concave portions when the rotating member is in the first position, and each of the at least one convex portion is detached from the plurality of concave portions when the rotating member is in the second position.

9. The torque socket tool of claim 6, wherein the mandrel is non-rotatably disposed within the bottom wall, one of the first restricting portion and the second restricting portion further includes a receiving groove, and the other of the first restricting portion and the second restricting portion further includes a polygonal column, the receiving groove has the plurality of concave portions radially communicated therewith, the polygonal column has the at least one convex portion radially protruding therefrom; when the rotating member is in the first position, the polygonal column is located within the receiving groove and each of the at least one convex portion is engaged with one of the plurality of concave portions; when the rotating member is in the second position, the polygonal column is detached from the receiving groove.

10. The torque socket tool of claim 1, wherein the main body further has a second sliding groove extending along the axial direction, the abutting member has a second restricting member disposed within the second sliding groove; each of the first engaging portion and the second engaging portion has a plurality of recesses arranged annularly, one of the first engaging portion and the second engaging portion further includes at least one engaging ball which is releasably engaged with one of the plurality of recesses of each of the first engaging portion and the second engaging portion; the mandrel has a threaded portion and slidably penetrates through the driving member, the engaging member, the elastic member and the rotating member, the threaded portion is screwed with the abutting member; an end of the mandrel has a flange radially protruding therefrom, an inner circumferential wall of the driving member has a first blocking portion protruding therefrom, a side of the flange facing the engaging member is blocked with the first blocking portion, another end of the mandrel opposite to the flange has a non-circular segment, the rotating member has a sleeving hole with a cross-section corresponding to a cross-section of the non-circular segment, the sleeving hole is slidably sleeved on the non-circular segment; the rotating member further has a bottom wall, the second restricting portion is disposed on the bottom wall, one of the first restricting portion and the second restricting portion includes at least one convex portion, the other of the first restricting portion and the second restricting portion includes a plurality of concave portions; when the rotating member is in the first position, each of the at least one convex portion is circumferentially restricted within one of the plurality of concave portions; when the rotating member is in the second position, the at least one convex portion is free of circumferential interference with the plurality of concave portions; the rotating member includes a large diametrical segment and a small diametrical segment having a smaller diameter than the large diametrical segment, the bottom wall is connected between the large diametrical segment and the small diametrical segment, the main body includes a barrel on which the first restricting portion is disposed; when the rotating member is in the first position, the large diametrical segment is radially overlapped with the barrel; when the rotating member is in the second position, the large diametrical segment is non-overlapped with the barrel in a radial direction of the barrel; one of an outer circumferential wall of the large diametrical segment and an outer circumferential wall of the main body has a first scale circumferentially disposed thereon, and the other of the outer circumferential wall of the large diametrical segment and the outer circumferential wall of the main body has an indication portion corresponding to the first scale, and a number and positions of scale marks of the first scale correspond to a number and positions of the plurality of concave portions; the mandrel is non-rotatably disposed within the bottom wall, the plurality of concave portions are annularly arranged on one of the bottom wall and the main body and extend along the axial direction, the at least one convex portion is formed as a rod-shaped and extends axially from the other of the bottom wall and the main body; each of the at least one convex portion is inserted within one of the plurality of concave portions when the rotating member is in the first position, and each of the at least one convex portion is detached from the plurality of concave portions when the rotating member is in the second position; an end of the mandrel remote from the driving member has a fastener, a diametrical dimension of a head portion of the fastener is larger than a diametrical dimension of the sleeving hole, a spring is sleeved on the mandrel and elastically abutted against and between the head portion and the bottom wall, the spring is tapered in a direction from the bottom wall toward the head portion; an outer circumferential wall of the driving member has an annular groove, the main body has at least one third restricting member disposed within the annular groove;

a peripheral edge of the second sliding groove has a second scale; the small diametrical segment is non-circular rod-shaped.

* * * * *